US009314803B2

(12) United States Patent
Henriksen et al.

(10) Patent No.: US 9,314,803 B2
(45) Date of Patent: Apr. 19, 2016

(54) ADJUSTABLE SLURRY SPREADER PLATE ASSEMBLY

(71) Applicants: John C. Henriksen, Jacksonville, FL (US); Thomas J. Grey, Jacksonville, FL (US)

(72) Inventors: John C. Henriksen, Jacksonville, FL (US); Thomas J. Grey, Jacksonville, FL (US)

( * ) Notice: Subject to any disclaimer, the term of this patent is extended or adjusted under 35 U.S.C. 154(b) by 109 days.

(21) Appl. No.: 13/975,318

(22) Filed: Aug. 24, 2013

(65) Prior Publication Data

US 2015/0052785 A1 Feb. 26, 2015

(51) Int. Cl.

| | |
|---|---|
| ***E02F 5/12*** | (2006.01) |
| ***E02F 5/22*** | (2006.01) |
| ***E02F 5/24*** | (2006.01) |
| ***B05B 3/00*** | (2006.01) |
| ***B05B 1/26*** | (2006.01) |

(52) U.S. Cl.
CPC .. *B05B 1/267* (2013.01); *E02F 5/24* (2013.01)

(58) Field of Classification Search
CPC ..... B05B 1/262; B05B 1/267; B05B 1/3033; B05B 1/3037; B05B 3/00; B05B 7/12; E02F 3/90; E02F 5/24; E02F 5/12; E02F 5/125; E02F 5/22; E02F 5/223; E02F 5/107
USPC ..... 239/505–510, 512–515, 518, 524, 239/288–288.5, 222.11, 597, 598, 599, 164, 239/170, 172, 176, 666; 137/527, 527.8; 37/335, 142.5, 333; 210/747; 405/73, 405/74, 136, 137
See application file for complete search history.

(56) References Cited

U.S. PATENT DOCUMENTS

| | | | | | |
|---|---|---|---|---|---|
| 326,072 | A | * | 9/1885 | Von Schmidt | E02F 3/905 37/335 |
| 550,244 | A | * | 11/1895 | Blagburn | F04F 5/22 138/44 |
| 799,256 | A | * | 9/1905 | Parker | 37/317 |
| 799,956 | A | * | 9/1905 | Parker | A47J 37/0713 126/41 R |
| 909,921 | A | * | 1/1909 | Markman | F16K 15/183 137/599.18 |
| 1,561,395 | A | * | 11/1925 | Adams | F16K 15/03 137/527.2 |
| 1,880,073 | A | * | 9/1932 | Colton | E02F 7/10 239/266 |

(Continued)

FOREIGN PATENT DOCUMENTS

| | | |
|---|---|---|
| EP | 0 102 751 A1 | 3/1984 |
| EP | 0237645 A2 | 9/1987 |
| GB | 2 113 515 A | 8/1983 |

OTHER PUBLICATIONS

Pichon Slurry Tankers (pdf of a 2011 catalog, 24 pages, France).

*Primary Examiner* — Arthur O Hall
*Assistant Examiner* — Joseph A Greenlund
(74) *Attorney, Agent, or Firm* — Arthur G. Yeager

(57) ABSTRACT

A spreader plate assembly for a pumped source of sand, water and rocks. Includes a generally horizontal plate spaced upstanding threaded rods affixed integrally with the plate, a splash guard affixed to the plate and located adjacent to a predetermined edge portion. An angled pipe receiving end attached to a pipe line containing slurry under pressure and an exiting end dispose above the plate located forward of the guard. Spaced arms extend horizontally from the exit end of the pipe and having collars slide on respective rods. Nuts are threaded below and above each collar, for adjusting distance between the exit end and plate to adjust the slurry output. Nuts adjust the collars to be equidistant from the plate, or the nuts on the forward rod can be adjusted to increase the distance of its collar from the plate to control the angle and control the direction of slurry.

20 Claims, 4 Drawing Sheets

(56) References Cited

U.S. PATENT DOCUMENTS 2,031,262 A * 2/1936 Hill, Jr. ..... E01C 19/174 222/626
3,939,863 A * 2/1976 Robison ..... 137/357
4,056,226 A * 11/1977 Hodgson ..... A01C 23/021 111/123
4,354,624 A * 10/1982 Chowdhury ..... B05B 1/3006 111/120
5,285,587 A * 2/1994 Krenzler ..... E02F 3/88 37/307
5,762,005 A * 6/1998 Parisi ..... F23G 7/04 110/234
6,793,154 B2 * 9/2004 Kost ..... A01C 17/001 239/288
7,159,889 B2 1/2007 Nuhn et al.
7,721,472 B2 * 5/2010 Buhr et al. ..... 37/317
7,744,012 B2 6/2010 Manders et al.

* cited by examiner

FIG. 2
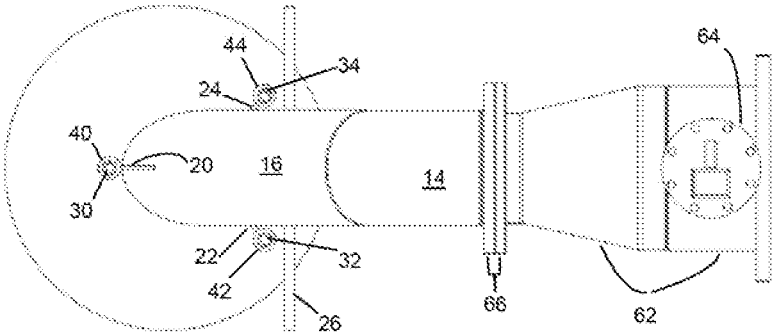
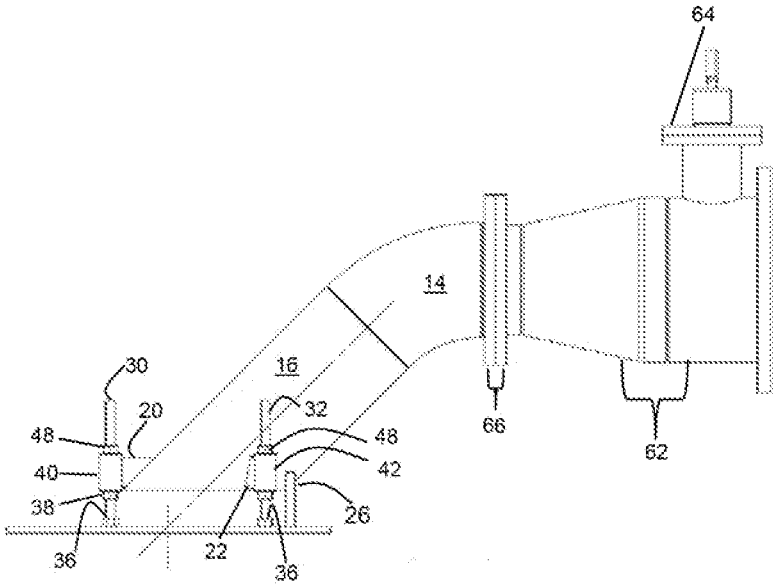
FIG. 3

ADJUSTABLE SLURRY SPREADER PLATE ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

FIELD OF THE INVENTION

This invention generally relates to slurry spreader plates that receives a pumped slurry via a pipeline terminating in a spreader plate for distribution of the slurry onto ground, marsh, surface of a body of water or the like to build a hill, island or the like.

BACKGROUND OF THE INVENTION

The prior art of slurry plates for distribution of the slurry are well known in the art. Many of the prior art relate to liquid manure spreaders represented by U.S. Pat. Nos. 4,056,226; 7,159,889 and 7,744,012; EP 0237645A2; EP Pub No. 0 102 751; and UK Pat. App 2 113 5115 A. Pichon Industries also has various spreader plates on and off some equipment in a PDF listing on the Internet. However, there remains a need for improvements in the prior art previously known, particularly for pumping a slurry made up from sand, water and small rocks that is created by dredging whether it be a sea or river floor, a source of sediment be it a barge or other container holding previously pumped slurry.

SUMMARY OF THE INVENTION

A spreader plate assembly is provided at the end of a pipeline that receives a pumped source of sand, water and rocks from a dredging operation. The assembly includes a generally horizontal spreader plate having a plurality of spaced upstanding threaded rods affixed integrally with the plate, an upstanding splash guard integrally affixed to the plate and located adjacent to a predetermined edge portion of the plate. An elongated angled pipe having one receiving end attached to a generally horizontal pipe line containing slurry under pressure and another exiting end dispose above the plate and located forward of the splash guard. A plurality of elongated arms extending horizontally and affixed to the other end of the angled pipe and respectively having a collar which slidably attached to the respective rods, a plurality of nuts threadedly attached below and above each of the collars, said nuts adjusting distance between the exit end of the pipe and the plate to adjust the slurry output transported therethrough. In such case the nuts adjust the collars to all be substantially equidistant from the plate. The nuts on the forward rod being adjustable to increase the distance of its collar from the plate to control the angle therebetween and control the direction of the slurry exiting therefrom.

A spreader plate assembly is attachable at the end of a pipeline that receives a pumped source of slurry and has a spreader plate with a plurality of spaced upstanding rods fixed to the plate, and an upstanding splash guard fixed to the plate and located adjacent to an edge portion of the plate. An elongated angled pipe having one receiving end attachable to a pipeline containing slurry under pressure and another exit end dispose above and parallel to the plate and located forwardly of the splash guard. A plurality of elongated arms extend outwardly and are fixed to the other end of the angled pipe, each of the arms having a connector at its outer end movably disposed on respective rods. Adjustment devices are disposed on the rods and located below and above each of the outer ends of the arm to adjust and vary the distance between the exit end of the pipe and the plate for changing the slurry output transported therethrough, the adjustment devices selectively maintaining outer ends of the arms in selectable positions. The adjustment devices on the forward rod being adjustable to increase the distance of its outer end of the arm from the plate while maintaining the other outer ends of the arms generally at the same distance from the plate so that the angle between the exit end of the angled pipe and the plate is an acute angle and thus controls the direction of the slurry exiting therefrom.

A plurality of protective resilient cylinders each having opposed ends surround at their upper ends the lower adjustment devices below the outer ends of the arms and the other ends of the cylinders are engaged with the plate. The adjustment devices may be nuts where the rods are threaded. A supporting nut is threaded on each lower end of the rods and the supporting nuts and rods being welded to the plate. The protective resilient cylinders having opposed ends and surrounding, and spanning between each of the pair of spaced nuts below each of the outer ends of the arms.

The angle pipe is substantially 45° from the horizontal, and the another end of the angled pipe is cut at an angle of substantially 45° from the plate. The acute angle between the exit end of the angled pipe and the plate is between 0° and 10° and preferably between 2° and 5°.

BRIEF DESCRIPTION OF THE DRAWINGS

The novel features believed to be characteristic of this invention are set forth with particularity in the appended claims. The invention itself, however both as to its organization and method of operation, together with further objects and advantages thereof, may best be understood by reference to the following description taken in connection with the accompanying drawings in which:

FIG. 2 is a top plan view thereof;

FIG. 3 is a right side elevational view thereof;

DETAILED DESCRIPTION OF THE INVENTION

Figure 1:
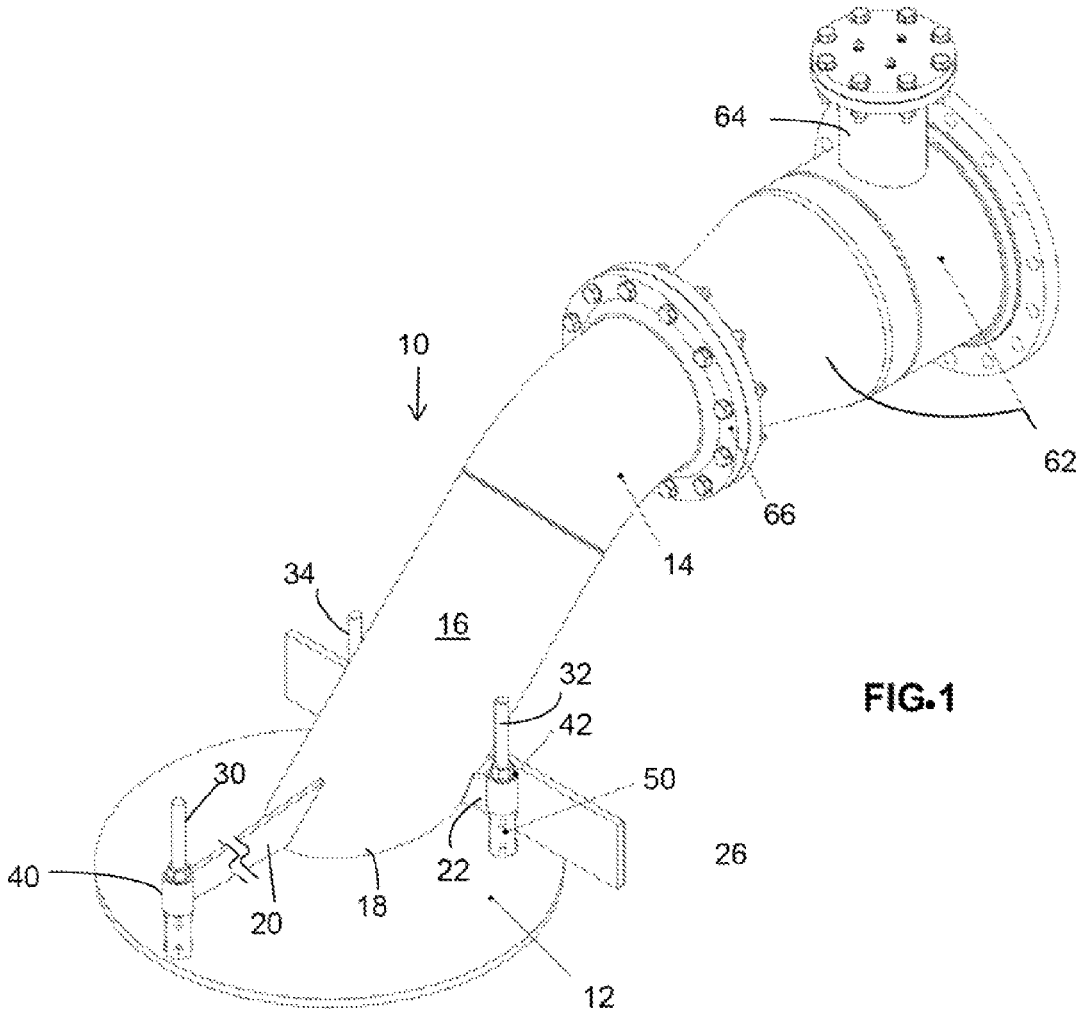
FIG. 1 is a perspective view of the spreader plate assembly in accordance with this invention.
Figure 4:
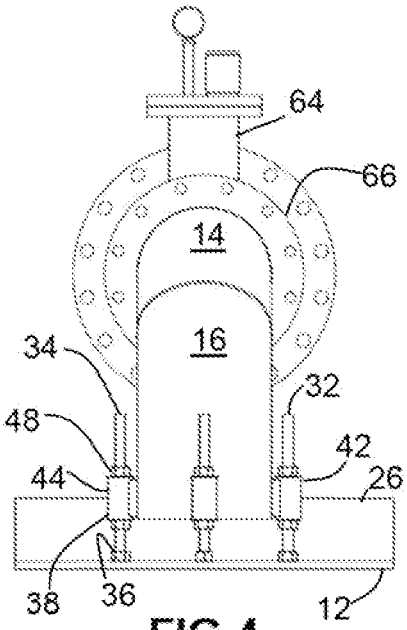
FIG. 4 is a front elevational view thereof.
Figure 5:
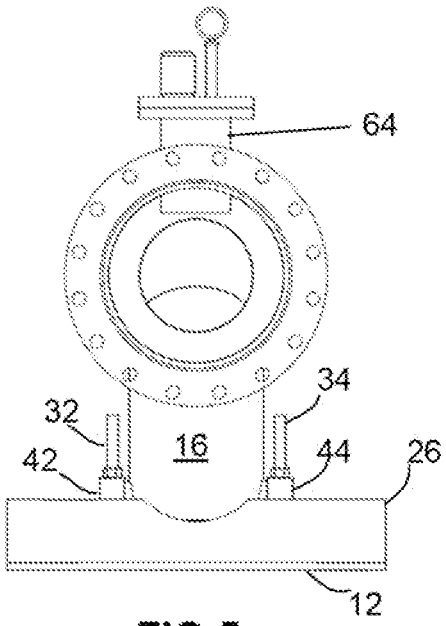
FIG. 5 is a rear elevational view thereof.

Referring now more specifically to the drawing of FIG. 1, numeral 10 refers generally to the slurry plate assembly including spreader plate 12 extending generally horizontally, and angled pipe or 45° elbow 14 which may include an extension pipe 16 which are generally angled at 45 from the horizontal. Pipe 16 exit end 18 is cut along the horizontal resulting in exit end 18 being substantially parallel to plate 12, as seen in FIGS. 3 and 4. A plurality of spaced arms 20, 22, and 24 are welded adjacent to the exit end 18 with arm 20 being forward and arms 22 and 24 being rearwardly adjacent to a splash guard 26 integrally affixed to plate 12 located at a predetermined location adjacent an edge portion of the plate and rearwardly of the exit end 18 of pipe 16. It is to be noted that the arm 20 is cut in FIG. 1 to indicate that the length of the arm 20 is not critical, for example, see the shorter arm length in FIGS. 2-5 and 7.

Figure 6:
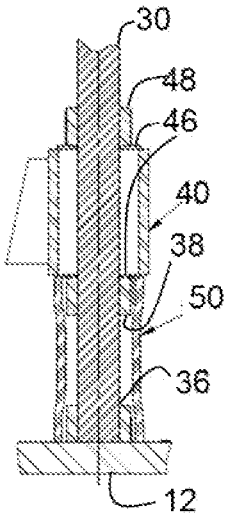
FIG. 6 is an enlarged partial sectional view depicting one of the three threaded up-right attaching members shown in FIG. 4.

The spreader plate 12 includes a plurality of spaced members in the form of threaded rods 30, 32, 34 welded lower nuts 36 which are welded to the plate 12 which respectively receive connectors in the form of collars 40, 42, 44 slidable thereon. As shown in FIG. 6, each of the rods including rod 30, is threaded onto lower nut 36 is also welded to the plate 12. Spaced above nut 36 is another adjustment device in the form of a nut 38 threaded on rod 30 and on which collar 40 is supported. Above nut 38 and above collar 40 are washers 46 with an upper adjustment device in the form of a nut 48 threaded on rod 30 and this fixes the collar 40 in place at adjustable heights between the collar 40 and plate 12. An elastic and resilient boot 50 spans between the lower pair of nuts 36, 38, as shown, to protect these areas from erosive wear during use of the assembly 10. It is to be noted that boot 50 may be a bellows type and/or cut to a maximum length that would be expected to be set for the usual distance between the exit end 18 of the pipe 16 and plate 12.

Figure 7:
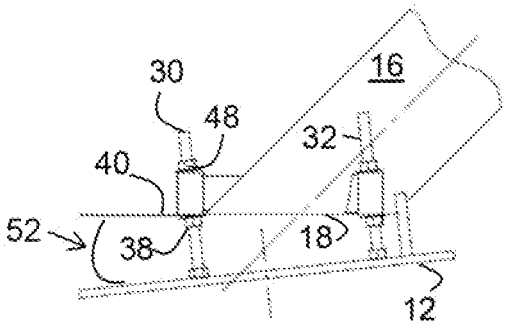
FIG. 7 is a partial right elevational view showing the spreader plate at an acute angle downwardly from the horizontal end of the pipe.

FIG. 7 illustrates the adjustment of the forward collar 40 by loosening upper nut 48 to locate it higher on rod 30 and rotating the nut 38 beneath the collar 40 until the collar 40 is tightly set by nuts 38 and 48. Such adjustment results in an acute angle 52 being formed between the exit end 18 of pipe 16 and the plate 12. In order to achieve such adjustments a user may need to slightly loosen the other upper nuts 48 on rods 32 and 34. It is intended that the acute angle 52 be between 1° and 10° and more likely set between 2° and 5°, in practice.

Figure 8:
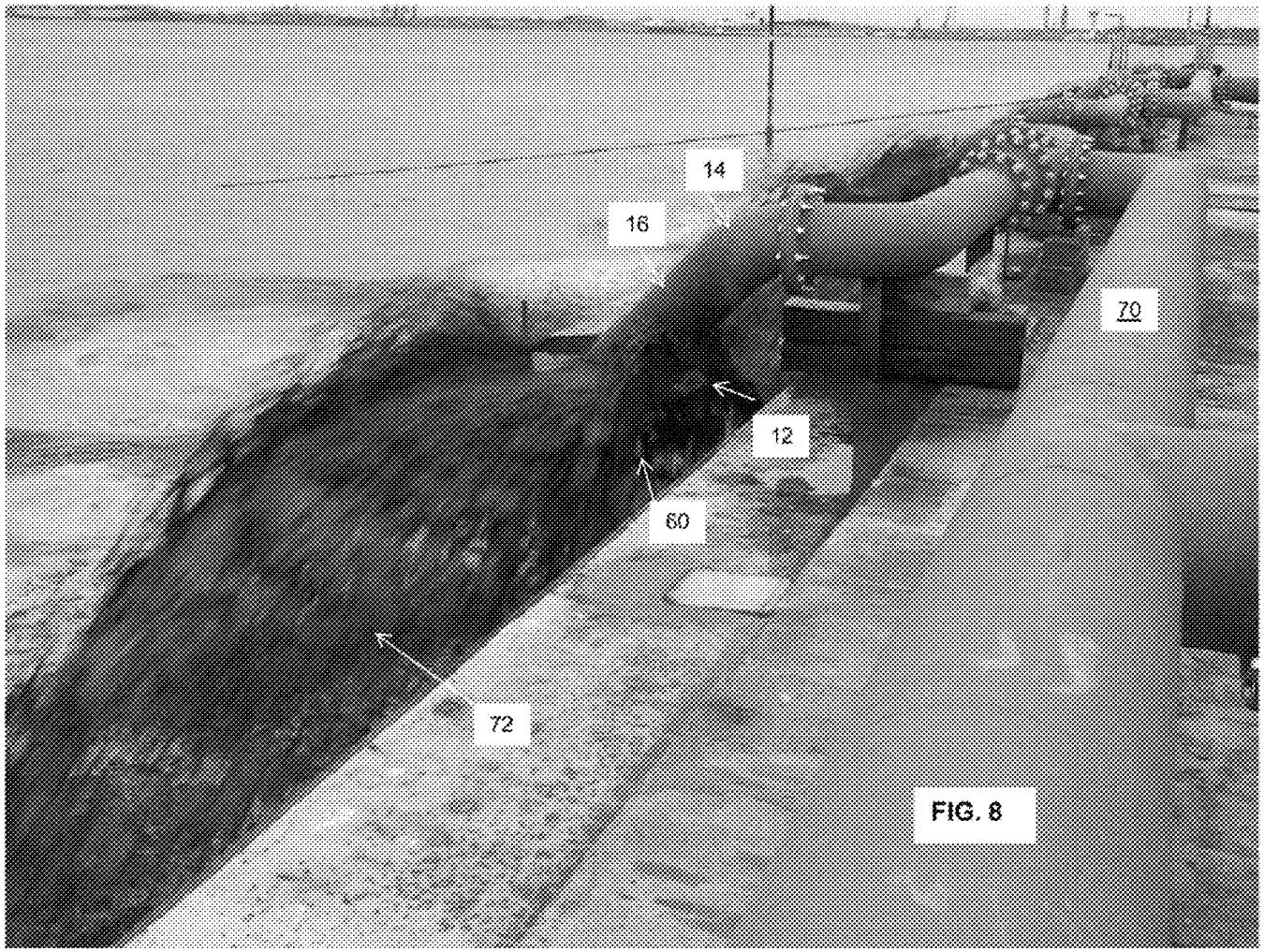
FIG. 8 is a photograph with the spreader plate assembly attached to a typical pipeline on shore.

Referring back to FIG. 1, the slurry would be pumped via a pipeline to a reducer 62 which includes a standpipe 64 and then via mating connecting flanges 66 into elbow 14 and extension pipe 16 and out exit end 18 onto spreader plate 12. As seen in the photograph FIG. 8, the slurry 60 is seen to travel from a pipeline 70 without a reducer 62, via angled pipe 14, extension 16 and onto plate 12 and building an island therebelow represented by area 72. In FIG. 8 another island or part of the same island is shown in the above in the upper right hand corner of the photograph.

A spreader plate assembly 10 is attachable to the end of a pipeline 70 that receives a pumped source of a slurry 60 of sand, water and rocks from a dredging operation. The assembly includes a generally horizontal spreader plate 12 having a plurality of spaced upstanding rods 30, 32, 34 affixed integrally with the plate 12. An upstanding splash guard 26 is integrally affixed to the plate 12 and is located adjacent to a predetermined edge portion of the plate 12. An elongated angled pipe 14,16 having one receiving end attachable to a generally horizontal pipeline 70 containing slurry under pressure and another exiting end 18 dispose above the plate 12 and located forwardly of the splash guard 26. A plurality of elongated arms extend horizontally and are affixed to the another exit end 18 of the angled pipe 14,16 with each of the arms having a connector in the form of a collar 40, 42, 44 slidably disposed on the respective rods.

The rods are preferably threaded and a plurality of nuts 36, 38, 40 are threaded on the rods 30, 32, 34 and are located below and above each of the collars 40, 42, 44 with washers 46 on each side of the collars, the nuts being adjustable to vary the distance between the exit end 18 of the pipe 14,16 and the plate 12 for changing the slurry output transported therethrough, the nuts 36, 38, 40 selectively maintaining all of the collars 40, 42, 44 to be substantially equidistant from the plate 12.

The nuts on the forward rod may be adjusted to increase the distance of its collar 40 from the plate 12 while maintaining the other collars 42, 44 generally at the same distance from the plate 12 so that the angle 52 between the exit end 18 of the angled pipe 14,16 and the plate 12 is an acute angle 52 and thus controls the direction of the slurry 60 exiting therefrom. A plurality of protective resilient cylinders have opposed ends surrounding at its upper end each of the lower nuts 38 and washers 46 below each of the collars 40, 42, 44 and the other end of the cylinders engaged with the plate 12. Each of the threaded rods 30, 32, 34 have a supporting nut 36 threaded thereon at its lower end, the rods and supporting nuts being welded to the plate 12. The aforesaid plurality of protective resilient cylinders surround and span between each of the pair of spaced nuts 36, 38 below each of the collars 40, 42, 44. The angle pipe is substantially 45° from the horizontal and the another end of the angled pipe is cut at an angle of substantially 45° from the horizontal.

Operation Summary

Pumping dredge slurry 60 (made of sand, water, and small pebbles or rock mixtures) is often utilized to build an island. The slurry is pumped from a specific location, whether from a river or sea floor, a sediment source, barge or a container containing previously pumped dredge slurry. Usually this requires a pump, not shown, and some length of pipeline 70.

The pump has a specific operating range to be most efficient. The length of pipeline 70 that the slurry 60 must flow is positively correlated with the amount of friction that the pump needs to overcome to allow the slurry 60 to flow through the pipeline 70. The flowrate of the slurry 20 is determined where the friction pressure of the pipeline system intersects the pressure produced by the pump at specific flow rates, i.e., the flowrate is determined where the "pump curve" intersects the "system curve". The "system curve" is not only determined by the friction of the pipeline 70, but also by increased friction caused by any valves, bends in the pipeline and any obstructions that may impede the flow of the slurry. Often it is desirable to increase the friction of the pipeline system, to allow the pump to intersect the system curve at a specific operating point. Depending on this intersection, the optimum operating region of the pump for optimum production of the transport of slurry) may be achieved. The added friction to the pipeline system is accomplished herein by adding a variable restriction to the pipeline at its exiting point.

A spreader plate assembly 10, in accord with this invention is located at the exiting point at the end of the pipeline 70, so that a higher pipe friction is produced when shortening the distance between the exiting end 18 of the pipe 16 and the spreader plate assembly 10. Shortening of the distance between the exiting end 18 of the pipeline and the spreader plate 12 is basically akin to placing a thumb over a hose outlet. The water will extend father than when unobstructed, but it also extends in unpredictable radial directions. To control and direct the flow of slurry 60, one often needs to adjust the angle from horizontal of the spreader plate 12. By adjusting the angle, the direction of flow can be controlled and the distance of the slurry spray can be optimized. A splash guard 26 affixed to the spreader plate 12 also inhibits the slurry 60 from a direction of travel in an uncontrolled manner, usually rearwardly.

Optimization of the spray distance is very important in island building. The slurry 60 is sprayed into a region, and as the slurry builds up, the slurry usually begins to slope and spread out. After the equipment heretofore that is distributing the slurry 60 has a chance of becoming stuck in the slurry that is building the island. Therefore, the farther away the equipment is from where the island is being built, the greater the change there will be no operational difficulties. By allowing for a longer distance when spraying or "rain bowing" the slurry 60 to build an island, a more diffuse spray pattern is achieved. A more diffuse spray pattern allows more even distribution of the slurry 60 when building an island and this inhibits uneven patterns in the island topography.

While the invention has been described with respect to certain specific embodiments, it will be appreciated that many modifications and changes may be made by those skilled in the art without departing from the spirit of the invention.

It is intended therefore, by the appended claims to cover all such modifications and changes as fall within the true spirit and scope of the invention.

The invention claimed is:

1. A spreader plate assembly attachable at the end of a pipeline that receives a pumped source of sand, water and rocks from a dredging operation, the assembly comprising:

a generally horizontal spreader plate having a plurality of spaced upstanding threaded rods affixed integrally with the plate;

an upstanding splash guard integrally affixed to the plate and located adjacent a predetermined edge portion of the plate;

an elongated angled pipe having one receiving end attachable to a generally horizontal pipe line containing slurry under pressure and another exiting end dispose above the plate and located forwardly of the splash guard;

a plurality of elongated arms extending horizontally and affixed to the other end of the angled pipe, each of the arms having a collar slidably disposed on the respective rods; and a plurality of nuts threaded on the rods and located below and above each of the collars, the nuts being adjustable to vary the distance between the exit end of the pipe and the plate for changing the slurry output transported therethrough, the nuts selectively maintaining all of the collars to be substantially equidistant from the plate.

2. The assembly as defined in claim 1 wherein the nuts on the forward rod being adjustable to increase the distance of its said collar from the plate while maintaining the other collars generally at the same distance from the plate so that the angle between the exit end of the angled pipe and the plate is an acute angle and thus controls the direction of the slurry exiting therefrom.

3. The assembly as defined in claim 2 further including a plurality of protective resilient cylinders having opposed ends surrounding at its upper end each of the lower nuts below each of the collars and the other end of the cylinders engaged with the plate.

4. The assembly as defined in claim 2 wherein the threaded rods each have a supporting nut threaded thereon at its lower end, the rods and supporting nuts being welded to the plate.

5. The assembly of claim 4 further including a plurality of protective resilient cylinders having opposed ends and surrounding and spanning between each of the pair of spaced nuts below each of the collars.

6. The assembly as defined in claim 1 wherein the angle pipe is substantially 45° from the horizontal.

7. The assembly as defined in claim 1 wherein the another end of the angled pipe is cut at an angle of substantially 45° from the horizontal.

8. The assembly as defined in claim 1 further including a plurality of protective resilient cylinders having opposed ends surrounding at its upper end each of the lower nuts below each of the collars and the other end of the cylinders engaged with the plate.

9. The assembly as defined in claim 1 wherein the threaded rods each have a supporting nut threaded thereon at its lower end, the rods being welded to the supporting nuts and the nuts being welded to the plate.

10. The assembly of claim 9 further including a plurality of protective resilient cylinders having opposed ends and surrounding and spanning between each of the pair of spaced nuts below each of the collar, the angle pipe being substantially 45° from the horizontal, and the another end of the angled pipe being cut at an angle of substantially 45° from the horizontal.

11. A spreader plate assembly attachable at the end of a pipeline that receives a pumped source of sand, water and rocks from a dredging operation, the assembly comprising:

a generally horizontal spreader plate having a plurality of spaced upstanding threaded rods affixed integrally with the plate;

an upstanding splash guard integrally affixed to the plate and located adjacent to a predetermined edge portion of the plate;

an elongated angled pipe having one receiving end attachable to a generally horizontal pipe line containing slurry under pressure and another exit end dispose above the plate and located forwardly of the splash guard;

a plurality of elongated arms extending horizontally and affixed to the other end of the angled pipes, each of the arms having a outer end movably disposed on the respective rods; and a plurality of nuts threaded on the rods and located below and above each of the outer ends of the arms, the nuts being adjustable to vary the distance between the exit end of the pipe and the plate for changing the slurry output transported therethrough, the nuts selectively maintaining outer ends of the arms in selectable positions; and, the nuts on the forward rod being adjustable to increase the distance of its outer end of the arm from the plate while maintaining the other outer ends of the arms generally at the same distance from the plate so that the angle between the exit end of the angled pipe and the plate is an acute angle and thus controls the direction of the slurry exiting therefrom.

12. The assembly as defined in claim 11 further including a plurality of protective resilient cylinders each having opposed ends surrounding at their upper ends the lower nuts below the outer ends of the arms and the other ends of the cylinders engaged with the plate.

13. The assembly as defined in claim 11 wherein the threaded rods each have a supporting nut threaded thereon at its lower end, the rods and supporting nuts being welded to the plate.

14. The assembly of claim 13 further including a plurality of protective resilient cylinders having opposed ends and surrounding and spanning between each of the pair of spaced nuts below each of the outer ends of the arms.

15. The assembly as defined in claim 11 wherein the angle pipe is substantially 45° from the horizontal.

16. The assembly as defined in claim 11 wherein another end of the angled pipe is cut at an angle of substantially 45° from the plate.

17. The assembly as defined in claim 11 where in the acute angle is between 0° and 10°.

18. The assembly as defined in claim 11 wherein the threaded rods each have a supporting nut threaded thereon at its lower end, the rods being welded to the supporting nuts and the nuts being welded to the plate, further including a plurality of protective resilient cylinders having opposed ends and surrounding and spanning between each of the pair of spaced nuts below each of the outer ends of the arms, the angle pipe being 45° from the horizontal.

19. The assembly as defined in claim 18 wherein another end of the angled pipe is cut at an angle of substantially 45° from the plate, the acute angle being between 0° and 10°.

20. The assembly as defined in claim 11 wherein the threaded rods each have a supporting nut threaded thereon at its lower end, the rods being welded to the supporting nuts and the nuts being welded to the plate, a plurality of protective resilient cylinders having opposed ends and surrounding and spanning between each of the pair of spaced nuts below each of the outer ends of the arms, another end of the angled pipe being cut at an angle of substantially 45° from the plate, and the acute angle being between 0° and 10°.

* * * * *